United States Patent [19]

Maltarp

[11] Patent Number: 4,998,316

[45] Date of Patent: Mar. 12, 1991

[54] CIRCULAR RING SHAPED BRUSH SECTION FOR SWEEPING MACHINE

[76] Inventor: Kim F. Maltarp, Hvidore 35, DK 6580 Vamdrup, Denmark

[21] Appl. No.: 346,550

[22] Filed: May 2, 1989

[30] Foreign Application Priority Data

May 3, 1988 [DK] Denmark ..... 2382/88

[51] Int. Cl.[5] ..... A46B 3/14

[52] U.S. Cl. ..... 15/181; 15/193; 15/198

[58] Field of Search ..... 15/190, 191 R, 192, 15/193, 194, 195, 199, 159 R, 197, 198, 181, 182

[56] References Cited

U.S. PATENT DOCUMENTS

| | | | |
|---|---|---|---|
| 376,800 | 1/1888 | Frisbie | 15/198 |
| 951,432 | 3/1910 | Bowditch | 15/192 |
| 1,706,159 | 3/1929 | Herold | 15/191 R X |
| 2,108,742 | 2/1938 | Bickel | 15/180 X |
| 2,400,809 | 5/1946 | Cane | 15/192 X |
| 2,778,048 | 1/1957 | Nielsen | 15/199 X |
| 2,963,730 | 12/1960 | Nelson | 15/182 |
| 3,142,081 | 7/1964 | Hartz | 15/193 X |
| 3,312,993 | 4/1967 | Nelson | 15/190 X |
| 3,335,443 | 8/1967 | Parisi | 15/193 X |
| 3,340,556 | 9/1967 | Allen | 15/159 R |
| 3,353,200 | 11/1967 | Charvat | 15/196 X |
| 3,675,265 | 7/1972 | Landen | 15/193 |
| 3,839,763 | 10/1974 | Gould | 15/181 |

FOREIGN PATENT DOCUMENTS 854670 6/1987 PCT Int'l Appl. .

*Primary Examiner*—Edward L. Roberts
*Attorney, Agent, or Firm*—Leonard Bloom

[57] ABSTRACT

A circular ring shaped brush section for sweeping machines, and procedure for production of such brush section is provided. The individual wires (4) in the brush section are held in position mutually in an area close to the internal periphery of the brush section by means of a ring-shaped layer (7) of a thermoplastic material and by a ring (6) which is clamped round the wires (4) and the ring-shaped layer (7). The brush section can be produced as follows: a sheaf of wires (4) is first creased and cut to length whereafter the wires (4) are cut to accurate length and then a layer (7) of a thermoplastic material is moulded or extruded on one end of the wires (4). The wires (4) are then given the shape of a coherent wire matting. The material (7) is surface cooled in a cooling device (12) whereafter it is forced into shape in a compression and shaping device (13). Then the matting is cut to length and can either be taken out of the machine as semi-manufactures or passed on to a hydraulic press (15) where they are folded to a circular ring shape and fitted into a ring (6).

18 Claims, 9 Drawing Sheets

CIRCULAR RING SHAPED BRUSH SECTION FOR SWEEPING MACHINE

FIELD OF THE INVENTION

The present invention relates to a brush section for a sweeping machine and a procedure for the production of such a brush section.

The known types of brush section consist of a number of wires which are folded at the middle and are thereby given a mainly U-shaped form. The wires are held together by means of a number of locking wires placed inside the U-shaped wires close to the fold point. Then they are folded and cut so that a circular ring is formed. This circular ring is mounted with a locking ring at the internal periphery of the ring.

It is a drawback in these known brush sections that the brushes are not homogeneous, that they are difficult to produce, require a long learning time, six months or more, for the operators, and that they are therefore expensive to produce. It is the purposes of the present invention to describe a brush section which does not have the drawbacks of the known brush sections.

SUMMARY OF THE INVENTION

The drawbacks of the known brush sections can be overcome by shaping the brush sections. The individual wires in the brush section are held together mutually in an area close to the internal periphery of the brush section by a hub-shaped layer of thermoplastic material and this hub has an internal diameter d and an external diameter $D_3$, and by a circular ring which is clamped round the internal periphery of the wire and the hub of thermoplastic material. This has the effect that the brushes in the brush section become homogeneous, that the learning time for the operators become very short, that the speed of production can be increased, and that the brush sections become cheaper to produce. Furthermore, the brush sections can be produced as semi-manufactures.

The invention will be explained in detail below with reference to the drawing.

BRIEF DESCRIPTION OF THE PREFERRED EMBODIMENT

Figure 1:
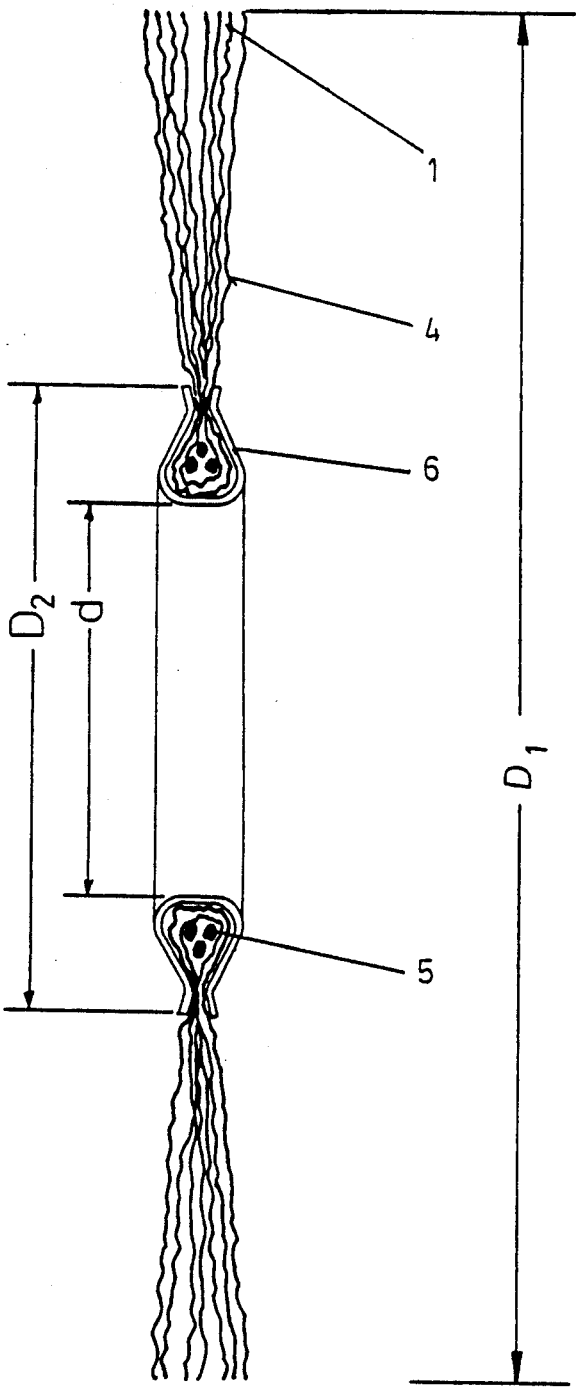
FIG 1 PRIOR ART
FIG. 1 shows a section through a known brush section.

As shown in FIG. 1 a known brush section consists of a number of mainly radial wires 4 folded at the middle so that the individual wire approximates a U-shape.

The wires are held in position as shown by a number of locking wires 5, which are located inside the U-shaped wires 4 the whole way round the internal periphery of the brush section. Round the wires 4 and the locking wires 5 is fitted a U-shaped ring 6 having a base and a pair of legs 8.

Figure 6:
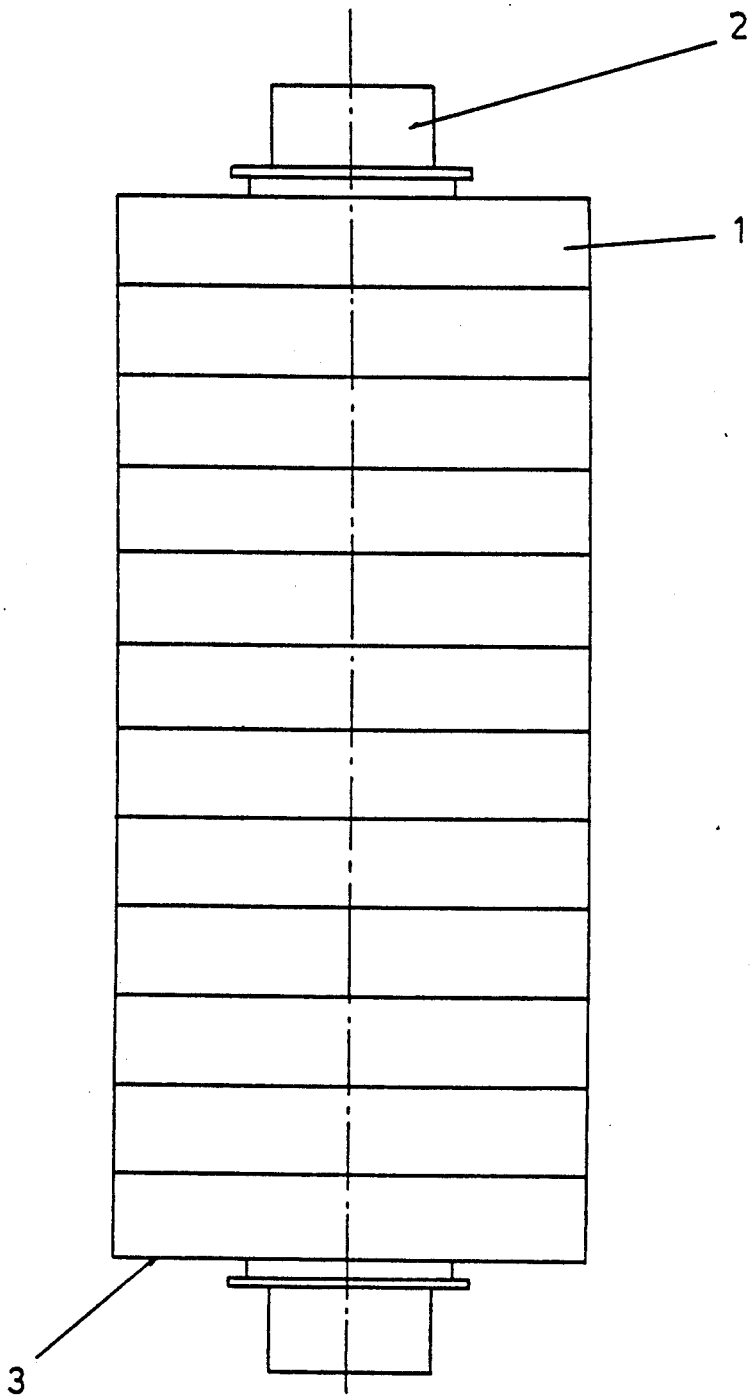
FIG. 6 is a schematic presentation of a brush consisting of a number of brush sections mounted on a shaft.

A number of brush sections 1 are mounted on a shaft 2 and together they form a cylinder-shaped brush unit 3 as shown in FIG. 6.

According to the invention the wires 4 are held together in a brush section 1 by a ring-shaped layer (hub) of a thermoplastic material. A ring 6 is forced (crimped) round the ring-shaped layer 7 and the wires 4. Each wire can be shaped as a single wire or as a wire folded at the middle to a U-shape.

The ring-shaped layer 7 has an internal diameter approximately equal to the internal diameter d of the ring 6 and an external diameter $D_3$ which is principally larger than, but may also be equal to or smaller than the outside diameter $D_2$ of the ring 6.

Figure 2:
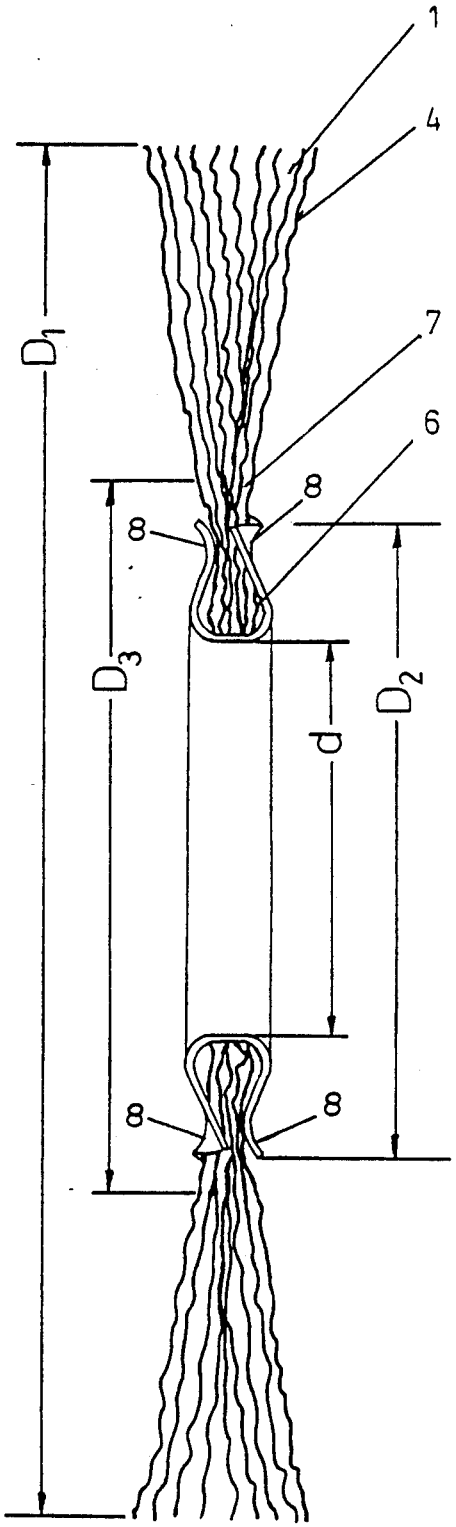
FIG. 2 shows a section through a brush section according to the invention.
Figure 2A:
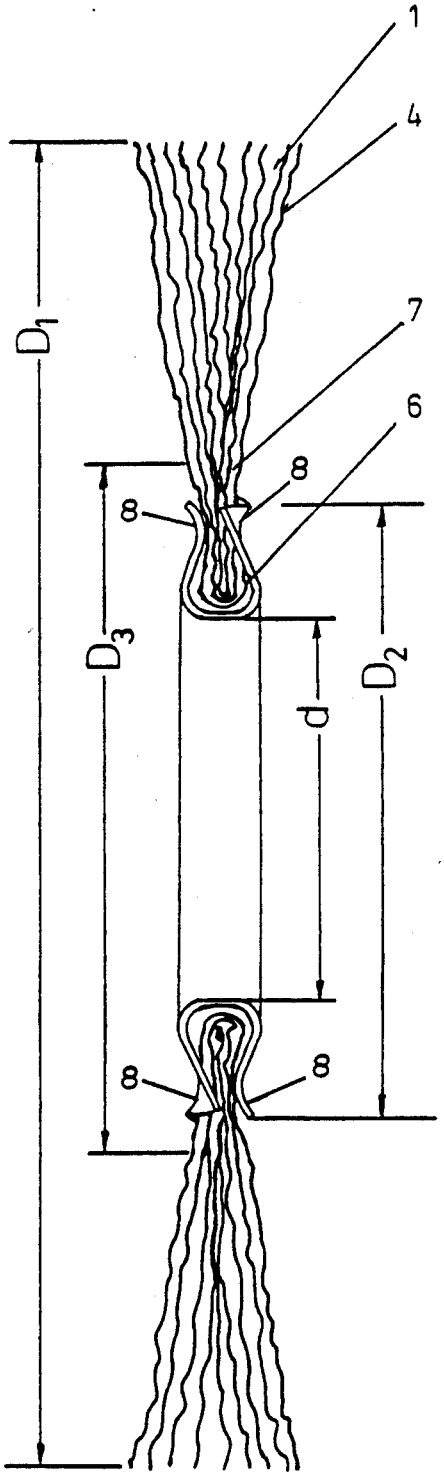
FIG. 2A shows a section through the brush section according to the invention showing U-shaped wires and the diameter of the thermoplastic hub being larger than the diameter of the inner metallic ring.
Figure 2B:
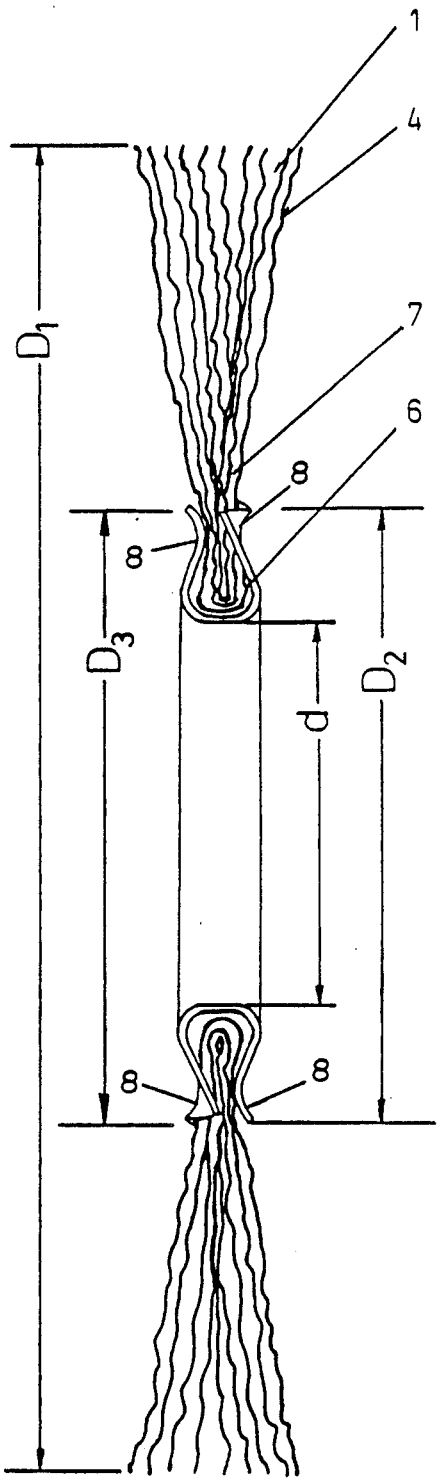
FIG. 2B shows a section through the brush section according to the invention showing U-shaped wires and the diameter of the thermoplastic hub being equal to the diameter of the inner metallic ring.
Figure 3:
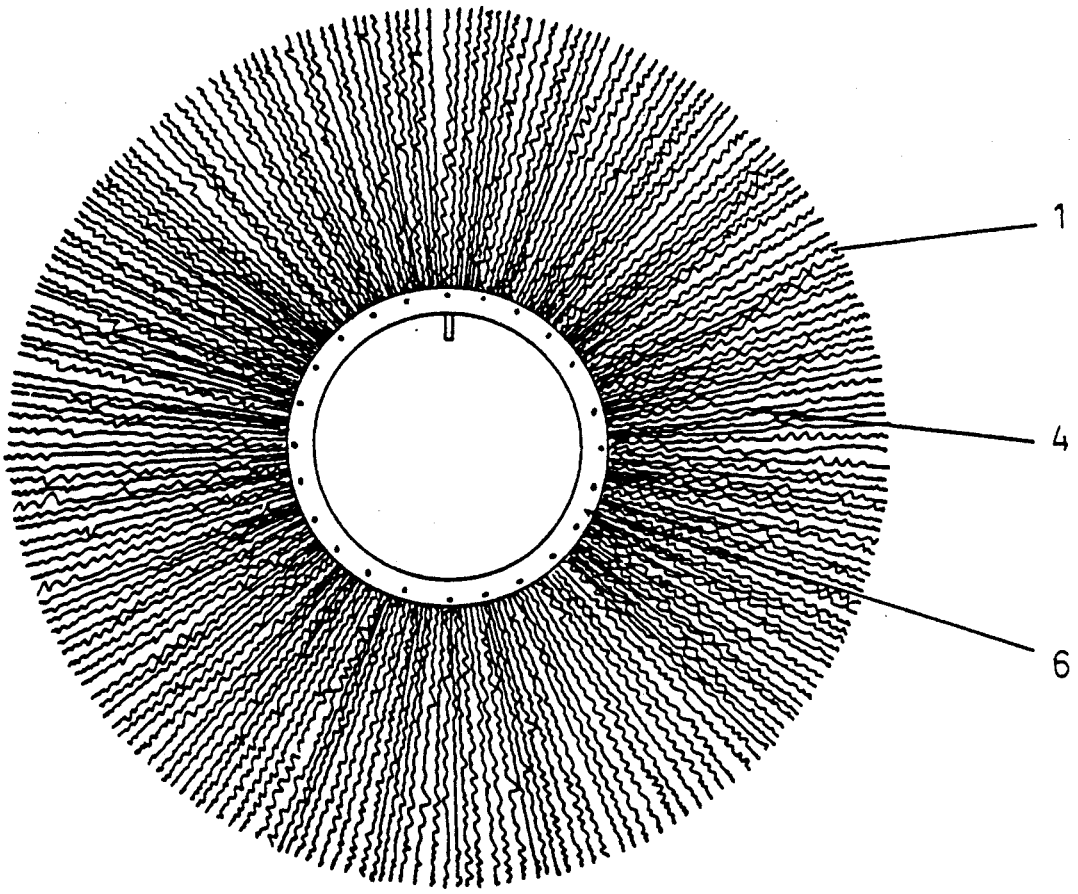
FIG. 3 shows, in a different scale, a plane section viewed from above.
Figure 4:
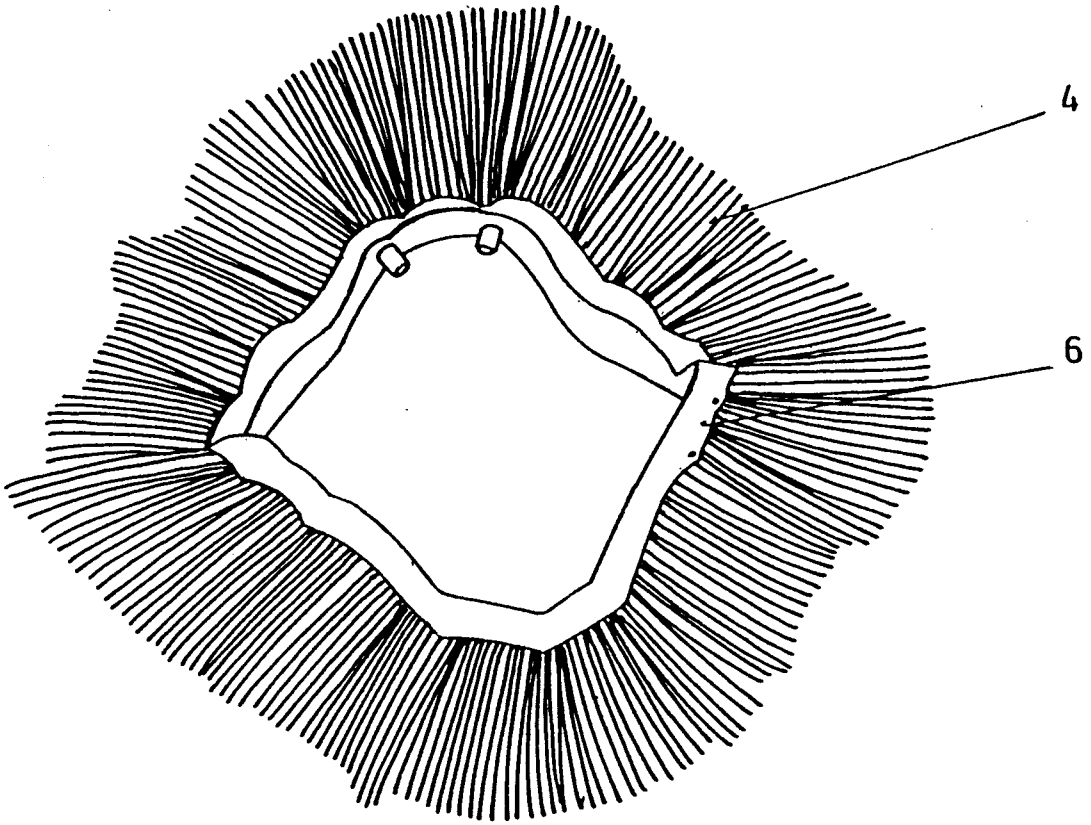
FIG. 4 is a perspective view of a zig-zag shaped brush section.

The wires 4 can, as shown in FIGS. 2 and 3 be made of steel brush wire such as "Rantex super quality high fatigue wire, type XP 7117G" or as shown in FIG. 4 of nylon, e.g. nylon 6.6, which is produced from a mixture of hexamethylenediamine and adipic acid, or another synthetic material.

Figure 5:
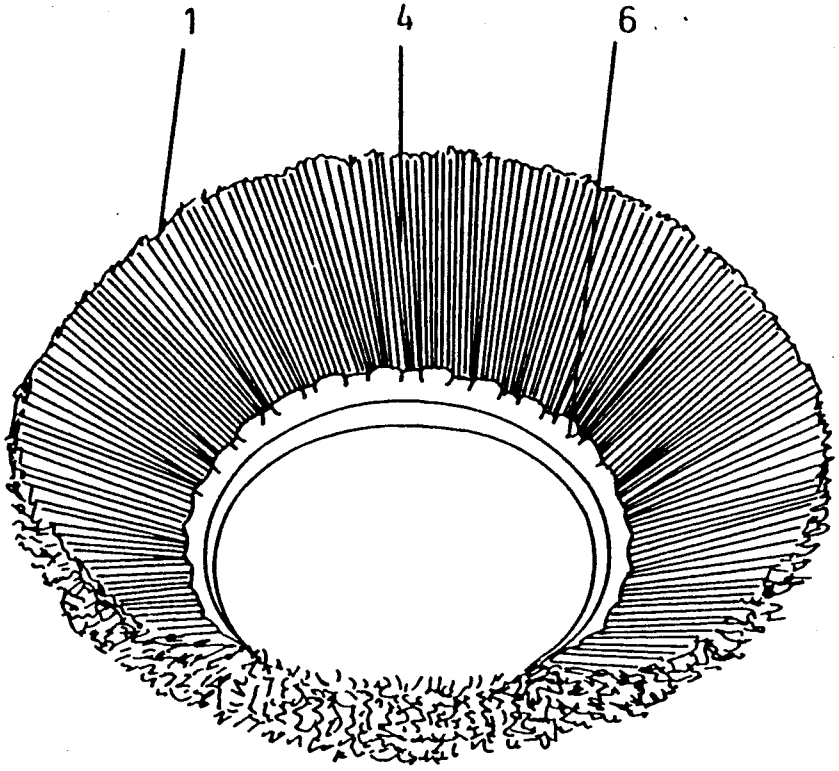
FIG. 5 is a perspective view of a truncated cone shaped brush section.

The ring-shaped layer 7 can be produced from a rubber plastic polymer or another thermoplastic material. As shown in FIG. 3 the brush section can be plane or zig-zag shaped as shown in FIG. 4, or of the shape of a truncated cone as shown in FIG. 5.

Figure 7:
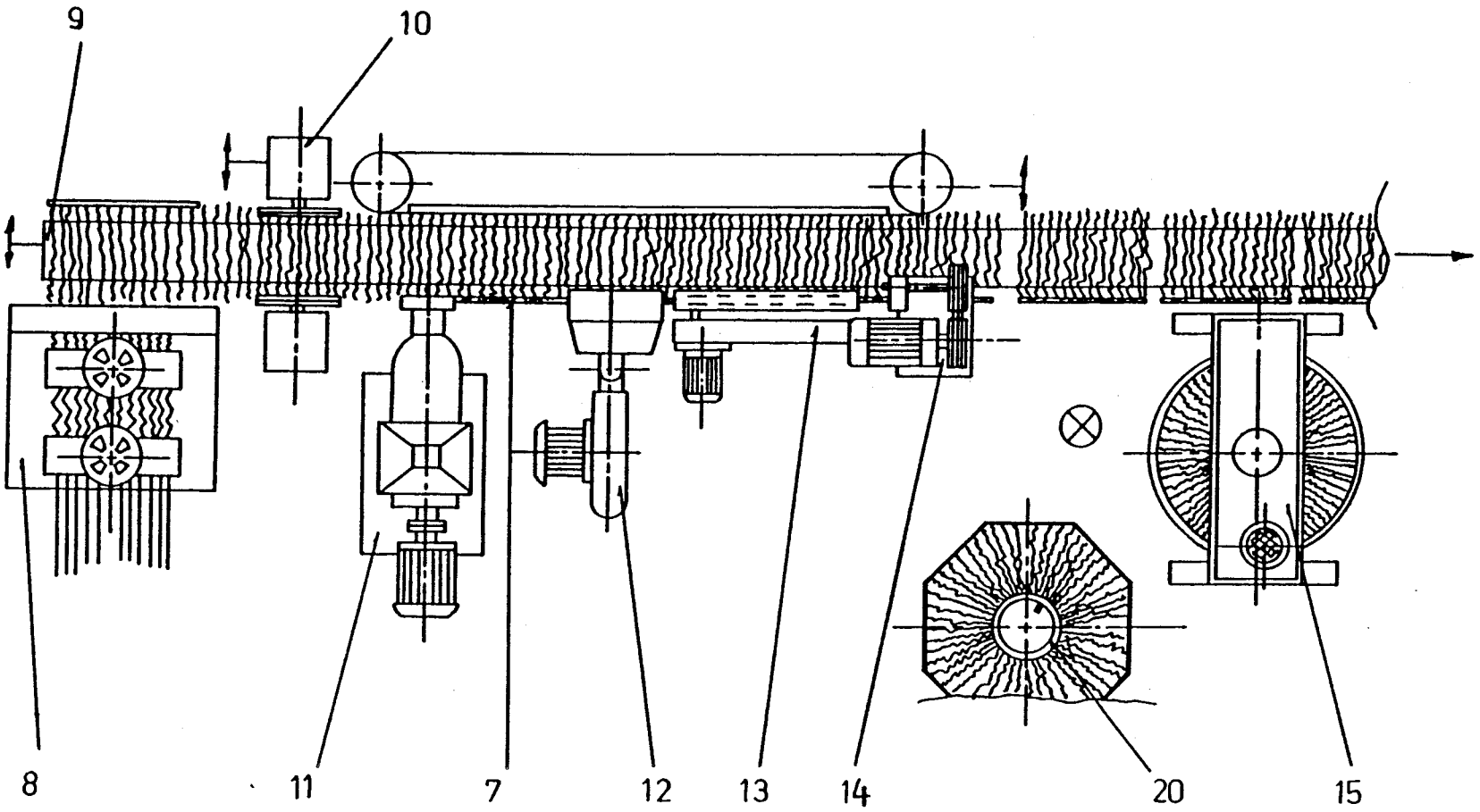
FIG. 7 shows a machine, viewed from above, for the production of brush sections according to the invention.
Figure 8:
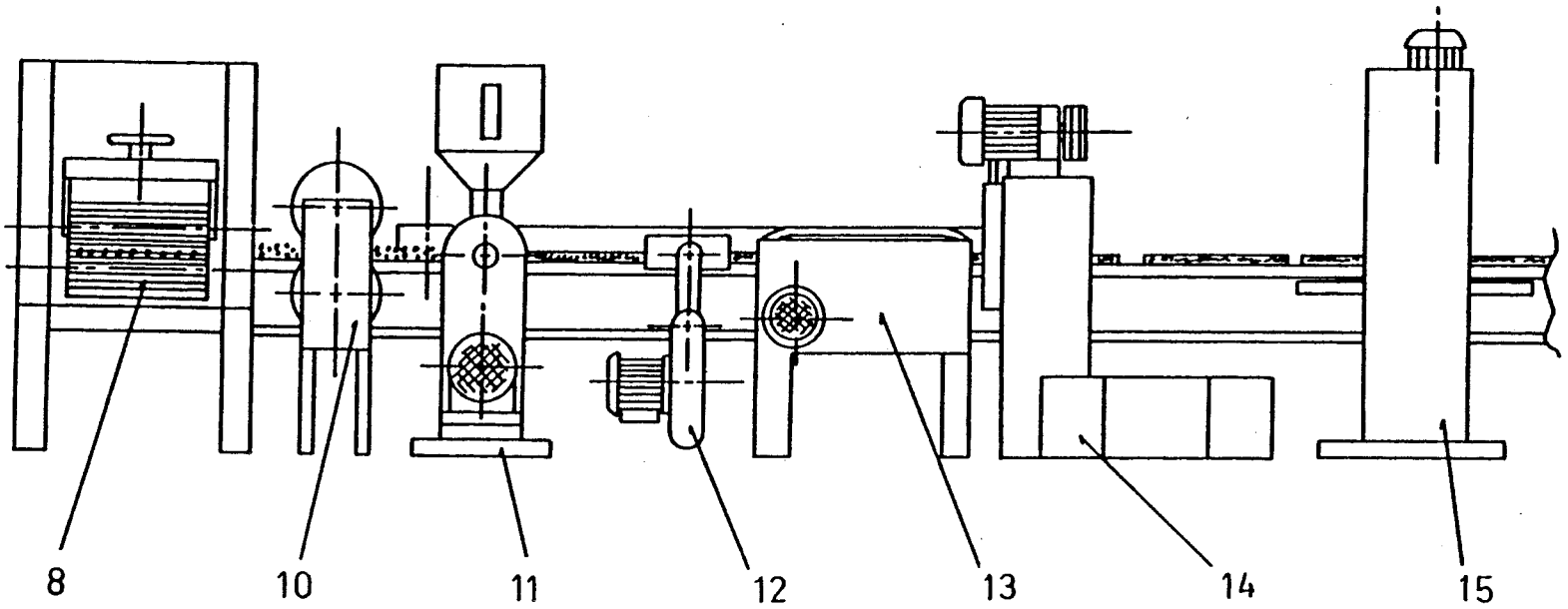
FIG. 8 is a side-view of the machine shown in FIG. 7 at the line II—II.
Figure 9:
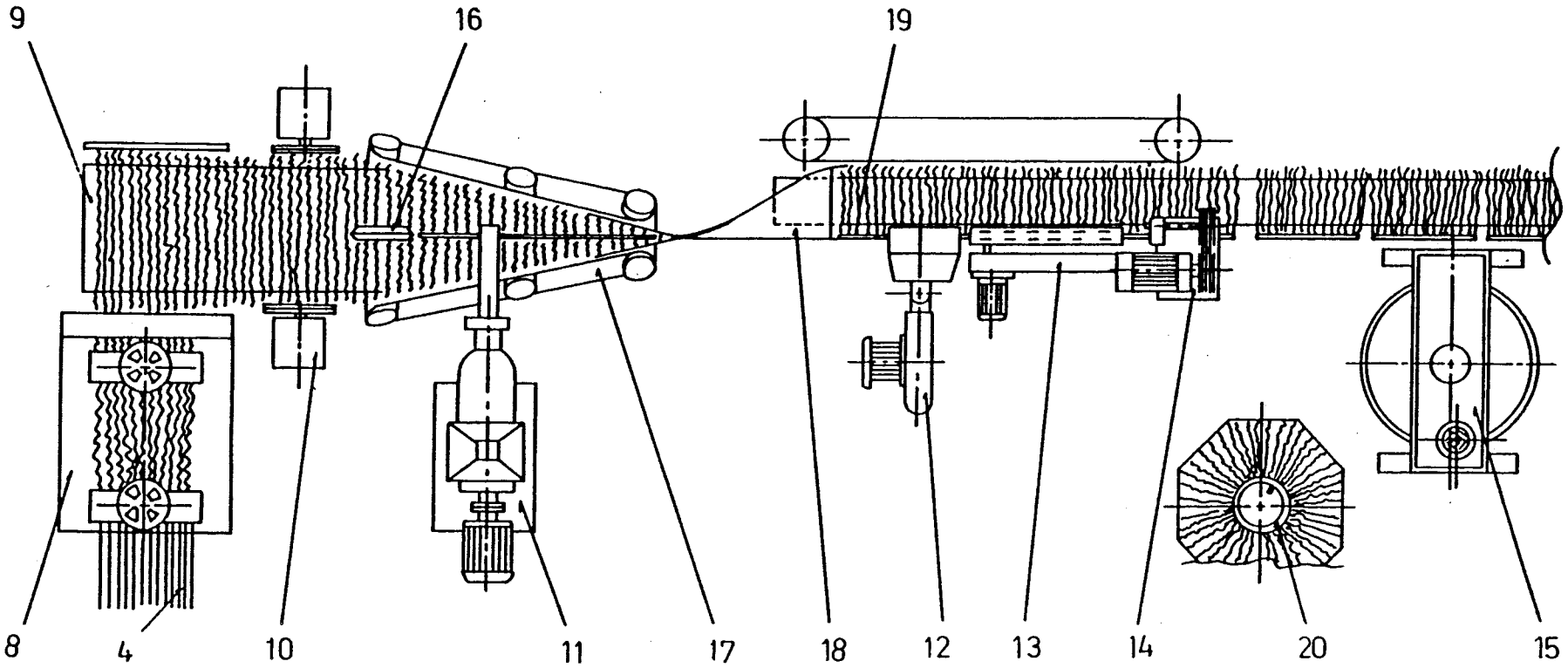
FIG. 9 shows another machine, viewed from above, for the production of brush sections according to the invention.

As shown in FIGS. 7 and 8 a brush section according to the invention can be produced by passing a sheaf of wires 4 through a rolling and cutting device 8 where the wires 4 are creased and cut to length.

Then the wires 4 are passed on to a conveyor belt 9 which takes the wires past a trimming device 10 where the wires are cut to accurate length, then past an extruder 11 where a string 7 of thermoplastic material is extruded on one side of the wires. Instead of an extruder a plastic spray moulding machine may be used. Thereafter the wires are passed past a cooling device 12, where the material 7 is surface cooled whereafter the wires pass through a compression and shaping device 13, where the material 7 is compressed and forced into shape. The wires 4 are now held together mutually by the material 7 and have the shape of a continuous wire mat which is cut to length in a cutting device 14. Thereafter the wire mats are conveyed on to a hydraulic press 15 where they are folded to a ring shape and where a ring 6 is fixed to them. The brush sections are now completed and can be packed at 20. The wire matting can also be stored as semi-manufactures, in which case they are by-passed the hydraulic press 15.

At the described method of production the wires have a length of approximately $(D_1-d)/2$.

It is also possible in connection with the present invention to use wires of double length, $D_1-d$, and folded at the middle of the wire into a U-shape. In the same way as the above example the wires 4 are passed through a rolling and cutting device 8 whereafter they are moved on to a conveyor belt 9. Thereafter the wires are conveyed past a trimming device 10 whereafter the wires are conveyed past a roller 16 where the wires are folded at the middle to a V-shape with an apex angle of less than 90°. Thereafter the wires are conveyed past an extruder 11, where a string 7 is extruded from a thermoplastic material on to the middle of the wires where they are folded. Thereafter the wires, which now have the shape of a wire mat, are conveyed through a first guiding device 17 where the wires are further folded so that they are given an approximate U-shape, and through a second guiding device 18 where the wires 4 are folded to their final shape, and where the folded wires are then turned from a vertical to a horizontal position and placed on a conveyor belt 19. The wire mats are then—in the same way as in the previous example—moved past a cooling device 12, a compressing and shaping device 13, and a cutting device 14, whereafter the wire mats are either completed as semi-manufactures or moved through a hydraulic press 15 where they are completed into the final product.

The shown and described embodiments and procedures serve only as examples. It is possible within the concept of the invention to think of other embodiments. The brush section may thus have a shape, which deviates from the zig-zag shaped and truncated cone shaped ring.

I claim:

1. Circular ring shaped brush section with internal diameter d and external diameter $D_1$ for mounting on a shaft on which a number of brush sections can be mounted, so that together they form a cylindrical brush and which consists of a number of mainly radially oriented creased wires which have an approximate length of $D_1=d$ and are folded at the middle to a U-shape, and by a circular ring with an internal diameter d and external diameter $D_2$ which is clamped round the wires in the brush section characterized by the fact that the individual wires in the brush section are held together mutually in a continuous hub in an area close to the internal periphery of the brush section by a hub-shaped layer (7) of thermoplastic material, the hub having an internal diameter d and an external diameter $D_3$ the external diameter $D_3$ of the hub being at least as large as the external diameter $D_2$ of the ring, the individual wires in the brush section further being held together by the circular ring, said circular ring being clamped around the hub of the thermoplastic material such that the individual wires extend outwardly from the thermoplastic material and such that the individual wires are prevented from contacting the circular ring.

2. Brush section according to claim 1 characterized by each wire being of the shape of an unfolded single wire.

3. Brush section according to claim 1 characterized by the fact that the external diameter $D_3$ of the hub is larger than the external diameter $D_2$ of the ring.

4. Brush section according to claim 1 characterized by the fact that the wires are made of steel brush wire.

5. Brush section according to claim 1 characterized by the wires being made of nylon.

6. Brush section according to the claim 1 characterized by the fact that the hub-shaped layer consists of a thermoplastic polymer.

7. Brush section according to claim 1 wherein the brush section comprises the individual wires extending outwardly in a plane.

8. Brush section according to claim 1 wherein the brush section comprises the individual wires extending outwardly in an irregular zig-zag shape.

9. Brush section according to claim 1 wherein the brush section comprises the individual wires extending outwardly in a truncated cone shape.

10. A brush section for mounting on a shaft on which at least one brush section may be mounted, the brush section comprises:

a plurality of adjacent, spaced apart wires, each wire having a first end and a second end; the first ends of the wires having a coating of thermoplastic material thereon such that the individual ends of the wires are secured thereby, the first ends being joined together to form substantially the shape of a continuous hub, such that the second ends of the wires extend outwardly from the hub to form the working portion of the brush; and a containing ring mounted about the coated first ends of the wires to further secure the brush in a ring form, the ring being in contact with the thermoplastic material such that the wires are prevented from contacting the ring, thereby reducing wear on the wires.

11. The brush section of claim 10 wherein the wires are steel brush wires.

12. The brush section of claim 10 wherein the wires are nylon wires.

13. The brush section of claim 10, wherein the brush section is zig-zag shaped.

14. A brush section for mounting on a shaft on which at least one section may be mounted, the brush section comprising:

a plurality of adjacent, spaced apart wires, each having a first end, a second end and a mid portion; the wires being folded at the mid portion in substantially a U shape, the first and second ends of the wires being substantially equidistant from the mid portion, the mid portions of the wires having a coating of thermoplastic material thereon such that the individual mid portions are secured thereby and are formed in the shape of a continuous hub, such that the first ends and second ends of the wires are spaced apart extending outwardly separately and individually from the ring and from the thermoplastic material to serve on the working portion of the brush; a U-shaped containing ring mounted about the coated mid portions of the wires to further secure the brush in a ring form; the containing ring having legs thereon, the legs being crimped to contact the coating of thermoplastic material such that the wires are prevented from contacting the ring, thereby reducing wear on the wires.

15. The brush section of claim 14, wherein the wires are steel brush wires.

16. The brush section of claim 14, wherein the wires are nylon wires.

17. In a wire brush in the form of a disc and intended to be mounted on a rotating drive shaft wherein the brush comprises a plurality of wires, each wire having a first end, the first ends of the respective wires being arranged circumferentially of one another to form an overall continuous brush and each wire having a second end radiating outwardly therefrom, the improvement which comprises, in combination, means for joining the first ends of the respective wires together with a plastic material to form a plastic annular hub and an inner metallic ring disposed concentrically about the plastic annular hub, the inner metallic ring having a substantially U-shaped cross-section having legs thereon, the legs extending radially covering the diametrically opposed sides of the plastic annular hub, and the legs being crimped thereto.

18. In a wire brush in the form of a disc and intended to be mounted on a rotating drive shaft wherein the brush comprises a plurality of wires, each wire having a first end, the first ends of the respective wires being arranged circumferentially of one another to form an overall continuous brush and each wire having a second end radiating individually outwardly therefrom, the improvement which comprises, in combination, means for joining the first ends of the respective wires together with a plastic material to form a plastic annular hub, the second ends of the respective wires having a length extending outwardly from the plastic annular hub, the plastic annular hub having an internal diameter and an external diameter; an inner metallic ring, the inner metallic ring having an internal diameter and an external diameter, the internal diameter of the inner metallic ring being smaller than the internal diameter of the plastic annular hub, the external diameter of the plastic annular hub being at least as large as the external diameter of the inner metallic ring, the inner metallic ring being disposed concentrically about the plastic annular hub, the inner metallic ring having a substantially U-shaped cross-section having legs thereon, the legs extending radially along the diametrically opposed sides of the plastic annular hub, and the legs being crimped thereto.

* * * * *